US009638433B2

(12) United States Patent
Norrell et al.

(10) Patent No.: US 9,638,433 B2
(45) Date of Patent: May 2, 2017

(54) SYSTEM AND METHOD FOR MANAGING HVAC EXCESS AIR CONDITION

(71) Applicant: Trane International Inc., Piscataway, NJ (US)

(72) Inventors: Billy W. Norrell, Tyler, TX (US); Gregory S. Brown, Flint, TX (US); John Tanner Taylor, Flint, TX (US)

(73) Assignee: Trane International Inc., Piscataway, NJ (US)

( * ) Notice: Subject to any disclaimer, the term of this patent is extended or adjusted under 35 U.S.C. 154(b) by 539 days.

(21) Appl. No.: 13/630,579

(22) Filed: Sep. 28, 2012

(65) Prior Publication Data

US 2014/0090408 A1 Apr. 3, 2014

(51) Int. Cl.
*F25D 17/04* (2006.01)
*F24F 11/00* (2006.01)

(52) U.S. Cl.
CPC ..... *F24F 11/0012* (2013.01); *F24F 11/0076* (2013.01)

(58) Field of Classification Search
CPC ..... F24F 11/0012; F24F 11/0076
USPC ..... 62/186
See application file for complete search history.

(56) References Cited

U.S. PATENT DOCUMENTS

| | | | | |
|---|---|---|---|---|
| 5,161,608 | A | 11/1992 | Osheroff | |
| 5,179,524 | A * | 1/1993 | Parker et al. | 700/277 |
| 5,305,953 | A | 4/1994 | Rayburn et al. | |
| 6,298,912 | B1 | 10/2001 | Rayburn et al. | |
| 6,634,422 | B2 | 10/2003 | Rayburn et al. | |
| 6,997,390 | B2 | 2/2006 | Alles | |
| 7,062,830 | B2 | 6/2006 | Alles | |
| 2005/0156050 | A1* | 7/2005 | Shah et al. | 236/1 B |
| 2005/0178433 | A1* | 8/2005 | Zelczer et al. | 137/115.23 |
| 2009/0076658 | A1* | 3/2009 | Kinnis | F24F 11/0001 700/277 |
| 2010/0307733 | A1* | 12/2010 | Karamanos et al. | 165/254 |
| 2010/0320277 | A1* | 12/2010 | Stark | 236/1 B |

* cited by examiner

*Primary Examiner* — Larry Furdge
(74) *Attorney, Agent, or Firm* — Conley Rose, P.C.; J. Robert Brown, Jr.; Michael J. Schofield

(57) ABSTRACT

A heating, ventilation, and/or air conditioning (HVAC) system includes a bypass duct configured to selectively receive a bypass airflow therethrough in response to a supply air pressure of the HVAC system and a supply air temperature of the HVAC system.

15 Claims, 5 Drawing Sheets

SYSTEM AND METHOD FOR MANAGING HVAC EXCESS AIR CONDITION

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Some heating, ventilation, and/or air conditioning (HVAC) systems utilize bypass ducts to manage excess air conditions. In some cases, use of bypass ducts to manage excess air conditions may undesirably overcool and/or overheat a component of the HVAC system, sometimes leading to a cessation of HVAC operation.

SUMMARY OF THE DISCLOSURE

In some embodiments of the disclosure, an HVAC system is disclosed that may comprise a bypass duct configured to selectively receive a bypass airflow therethrough in response to a supply air pressure of the HVAC system and a supply air temperature of the HVAC system.

In other embodiments of the disclosure, a method of managing an excess air condition of an HVAC system is disclosed. The method may comprise modulating airflow through a bypass duct by modulating a bypass damper in response to a supply air pressure and selectively discontinuing modulation of the bypass damper in response to a supply air temperature.

In yet other embodiments of the disclosure, a method of managing an excess air condition of an HVAC system is disclosed as comprising modulating airflow through a bypass duct by modulating a bypass damper in response to a supply air pressure, selectively discontinuing modulation of the bypass damper in response to a supply air temperature exceeding a supply air temperature threshold value, selectively increasing airflow to all calling same-mode zones in response to the supply air temperature exceeding the supply air temperature threshold value, after selectively increasing airflow to all calling same-mode zones, selectively increasing airflow to all non-calling same mode zones in response to the supply air temperature continuing to exceed the supply air temperature threshold value, and after selectively increasing airflow to all non-calling same-mode zones, selectively increasing airflow to at least one of an opposing-mode zone and an off-mode zone in response to the supply air temperature continuing to exceed the supply air temperature threshold value.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

Figure 1:
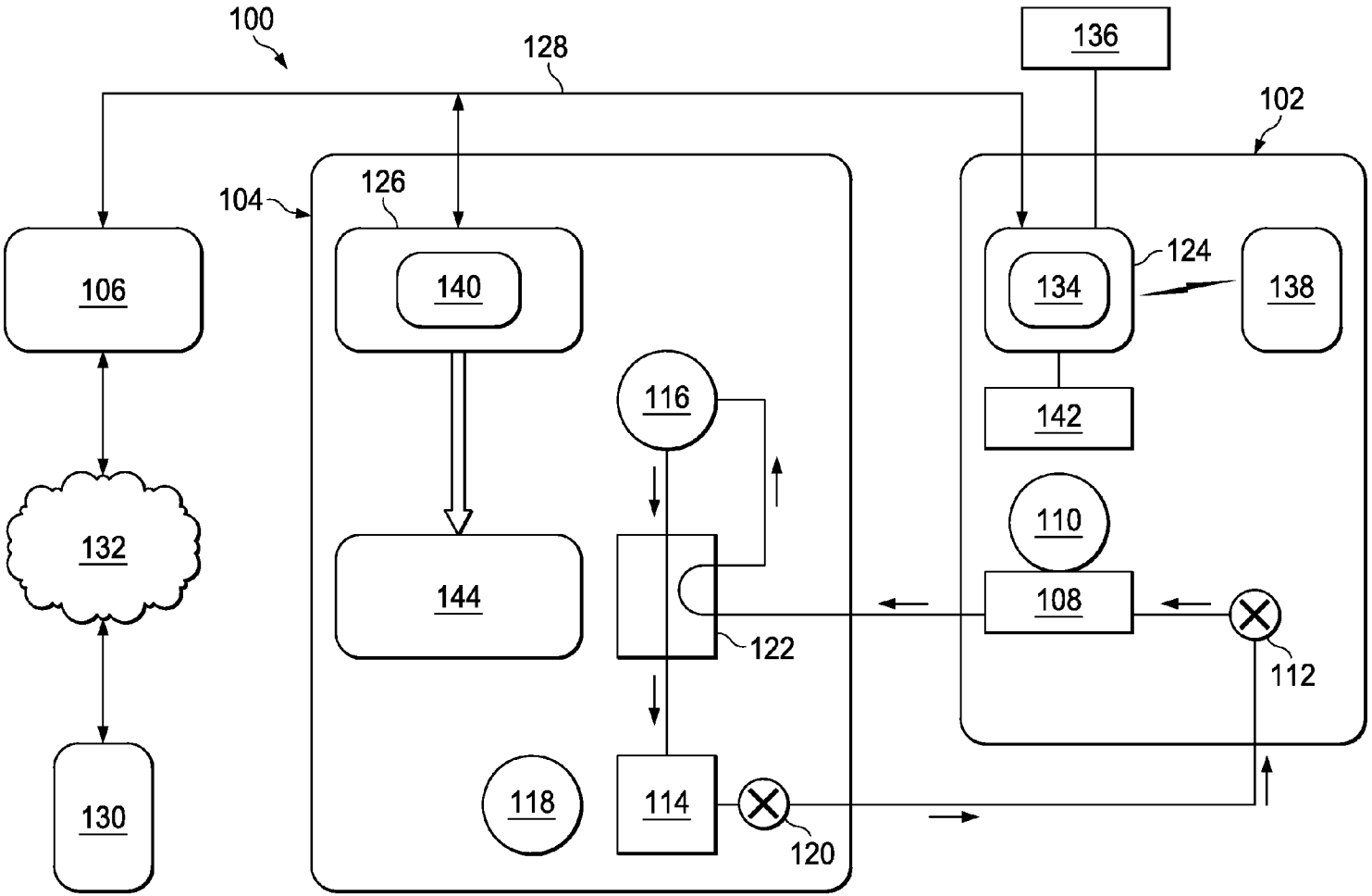
FIG. 1 is a schematic diagram of an HVAC system according to an embodiment of the disclosure.

In an HVAC system comprising zone dampers configured to modulate airflow to various zones, a so-called excess air condition may occur. Excess air may be defined as a condition where the amount of airflow provided by an HVAC system is greater than the amount of airflow needed by the zones being selectively supplied air. Put another way, an excess air condition may exist when the quantity of airflow generated by the HVAC system for delivery to a supply header is greater than the sum of the airflow needed by the zones. Some effects of excess air conditions may comprise increased air noise, increased static pressure, and/or overly conditioned air (e.g., conditioned air that is heated to a higher temperature or cooled to a lower temperature than during normal system operation).

In some HVAC systems, a bypass duct and an associated bypass damper may be used to mitigate an excessive air condition by selectively feeding a portion of the airflow generated by the HVAC system from the supply header back to a return header return so that airflow to the zones is selectively decreased. The bypass damper may be controlled as a function of a pressure of the supply header or other HVAC system airflow conduit that otherwise relates to a pressure against which a blower motor may work to deliver air.

In such an HVAC system, if a bypass duct fails to allow a sufficient amount of air to pass through the bypass duct, regardless of whether the failure is a control restraint of the bypass damper or a physical capacity limitation of the bypass duct, pressure within the supply duct may increase. An increase in supply duct pressure may decrease HVAC system efficiency and/or cause excessive noise. The excessive noise may generally be local to the blower and/or supply header as a result of an increased airflow delivery resistance. Also, excessive air delivery noise may occur in one or more zones until a sufficient amount of bypass airflow is provided.

On the other hand, allowing too much air to flow through the bypass duct may excessively heat or cool the air conditioned by the HVAC system. For instance, if the HVAC system is cooling air, the cool air entering the bypass duct will be further cooled because it may pass through cooling components of the HVAC system rather than being distributed to the various zones. This recirculation may have a compounding effect over time and cause the air to be cooled below a desired temperature, potentially resulting in insufficient HVAC system reliability as the HVAC system components may become too cool and at least temporarily fail. For example, an evaporator and/or cooling coil may become so cool that ice may form on the coil thereby reducing airflow through the coil. Likewise, if the HVAC system is heating air, the air may be heated above a desired temperature, potentially causing heat damage to HVAC system components and/or causing the system to shut down due to temperature related protective controls.

In other HVAC systems, excessive air conditions may be mitigated by dumping at least a portion of airflow to one or more zones that are not accounted for in the calculation of the air needed by the zones upon which the excessive air condition calculation is based. In yet other HVAC systems, the effects of excessive air conditions may be mitigated by selectively modulating a degree to which airflow exceeds the demands for one or more selected zones in accordance with zone control priorities and/or an extent to which a zone temperature differs from a desired temperature for the zone.

In some embodiments, an HVAC system is disclosed that may control a bypass damper as a function of supply air pressure and supply air temperature. In some embodiments, the HVAC system may selectively control the bypass damper in response to the a supply air pressure to allow increased airflow through the bypass duct, thereby potentially reducing supply air pressure and decreasing the excessive air condition. In some embodiments, the HVAC system may lock the bypass damper in place in response to the supply air temperature passing a threshold value. In some embodiments, the bypass damper may be locked in a position that allows a maximum amount of air to flow through the bypass damper and the bypass duct. In some embodiments, the HVAC system may utilize the above-described dumping and/or selective allowance of a zone to receive airflow that is not required to maintain a desired temperature for the zone.

Referring now to FIG. 1, a simplified schematic diagram of an HVAC system 100 according to an embodiment of this disclosure is shown. HVAC system 100 comprises an indoor unit 102, an outdoor unit 104, and a system controller 106. In some embodiments, the system controller 106 may operate to control operation of the indoor unit 102 and/or the outdoor unit 104. As shown, the HVAC system 100 is a so-called heat pump system that may be selectively operated to implement one or more substantially closed thermodynamic refrigeration cycles to provide a cooling functionality and/or a heating functionality.

Indoor unit 102 comprises an indoor heat exchanger 108, an indoor fan 110, and an indoor metering device 112. Indoor heat exchanger 108 is a plate fin heat exchanger configured to allow heat exchange between refrigerant carried within internal tubing of the indoor heat exchanger 108 and fluids that contact the indoor heat exchanger 108 but that are kept segregated from the refrigerant. In other embodiments, indoor heat exchanger 108 may comprise a spine fin heat exchanger, a microchannel heat exchanger, or any other suitable type of heat exchanger.

The indoor fan 110 is a centrifugal blower comprising a blower housing, a blower impeller at least partially disposed within the blower housing, and a blower motor configured to selectively rotate the blower impeller. In other embodiments, the indoor fan 110 may comprise a mixed-flow fan and/or any other suitable type of fan. The indoor fan 110 is configured as a modulating and/or variable speed fan capable of being operated at many speeds over one or more ranges of speeds. In other embodiments, the indoor fan 110 may be configured as a multiple speed fan capable of being operated at a plurality of operating speeds by selectively electrically powering different ones of multiple electromagnetic windings of a motor of the indoor fan 110. In yet other embodiments, the indoor fan 110 may be a single speed fan.

The indoor metering device 112 is an electronically controlled motor driven electronic expansion valve (EEV). In alternative embodiments, the indoor metering device 112 may comprise a thermostatic expansion valve, a capillary tube assembly, and/or any other suitable metering device. The indoor metering device 112 may comprise and/or be associated with a refrigerant check valve and/or refrigerant bypass for use when a direction of refrigerant flow through the indoor metering device 112 is such that the indoor metering device 112 is not intended to meter or otherwise substantially restrict flow of the refrigerant through the indoor metering device 112.

Outdoor unit 104 comprises an outdoor heat exchanger 114, a compressor 116, an outdoor fan 118, an outdoor metering device 120, and a reversing valve 122. Outdoor heat exchanger 114 is a spine fin heat exchanger configured to allow heat exchange between refrigerant carried within internal passages of the outdoor heat exchanger 114 and fluids that contact the outdoor heat exchanger 114 but that are kept segregated from the refrigerant. In other embodiments, outdoor heat exchanger 114 may comprise a plate fin heat exchanger, a microchannel heat exchanger, or any other suitable type of heat exchanger.

The compressor 116 is a multiple speed scroll type compressor configured to selectively pump refrigerant at a plurality of mass flow rates. In alternative embodiments, the compressor 116 may comprise a modulating compressor capable of operation over one or more speed ranges, the compressor 116 may comprise a reciprocating type compressor, the compressor 116 may be a single speed compressor, and/or the compressor 116 may comprise any other suitable refrigerant compressor and/or refrigerant pump.

The outdoor fan 118 is an axial fan comprising a fan blade assembly and fan motor configured to selectively rotate the fan blade assembly. In other embodiments, the outdoor fan 118 may comprise a mixed-flow fan, a centrifugal blower, and/or any other suitable type of fan and/or blower. The outdoor fan 118 is configured as a modulating and/or variable speed fan capable of being operated at many speeds over one or more ranges of speeds. In other embodiments, the outdoor fan 118 may be configured as a multiple speed fan capable of being operated at a plurality of operating speeds by selectively electrically powering different ones of multiple electromagnetic windings of a motor of the outdoor fan 118. In yet other embodiments, the outdoor fan 118 may be a single speed fan.

The outdoor metering device 120 is a thermostatic expansion valve. In alternative embodiments, the outdoor metering device 120 may comprise an electronically controlled motor driven EEV, a capillary tube assembly, and/or any other suitable metering device. The outdoor metering device 120 may comprise and/or be associated with a refrigerant check valve and/or refrigerant bypass for use when a direction of refrigerant flow through the outdoor metering device 120 is such that the outdoor metering device 120 is not intended to meter or otherwise substantially restrict flow of the refrigerant through the outdoor metering device 120.

The reversing valve 122 is a so-called four-way reversing valve. The reversing valve 122 may be selectively controlled to alter a flow path of refrigerant in the HVAC system 100 as described in greater detail below. The reversing valve 122 may comprise an electrical solenoid or other device configured to selectively move a component of the reversing valve 122 between operational positions.

The system controller 106 may comprise a touchscreen interface for displaying information and for receiving user inputs. The system controller 106 may display information related to the operation of the HVAC system 100 and may receive user inputs related to operation of the HVAC system 100. However, the system controller 106 may further be operable to display information and receive user inputs tangentially and/or unrelated to operation of the HVAC system 100. In some embodiments, the system controller 106 may comprise a temperature sensor and may further be configured to control heating and/or cooling of zones associated with the HVAC system 100. In some embodiments, the system controller 106 may be configured as a thermostat for controlling supply of conditioned air to zones associated with the HVAC system.

In some embodiments, the system controller 106 may selectively communicate with an indoor controller 124 of the indoor unit 102, with an outdoor controller 126 of the outdoor unit 104, and/or with other components of the HVAC system 100. In some embodiments, the system controller 106 may be configured for selective bidirectional communication over a communication bus 128. In some embodiments, portions of the communication bus 128 may comprise a three-wire connection suitable for communicating messages between the system controller 106 and one or more of the HVAC system 100 components configured for interfacing with the communication bus 128. Still further, the system controller 106 may be configured to selectively communicate with HVAC system 100 components and/or other device 130 via a communication network 132. In some embodiments, the communication network 132 may comprise a telephone network and the other device 130 may comprise a telephone. In some embodiments, the communication network 132 may comprise the Internet and the other device 130 may comprise a so-called smartphone and/or other Internet enabled mobile telecommunication device.

The indoor controller 124 may be carried by the indoor unit 102 and may be configured to receive information inputs, transmit information outputs, and otherwise communicate with the system controller 106, the outdoor controller 126, and/or any other device via the communication bus 128 and/or any other suitable medium of communication. In some embodiments, the indoor controller 124 may be configured to communicate with an indoor personality module 134, receive information related to a speed of the indoor fan 110, transmit a control output to an electric heat relay, transmit information regarding an indoor fan 110 volumetric flow-rate, communicate with and/or otherwise affect control over an air cleaner 136, and communicate with an indoor EEV controller 138. In some embodiments, the indoor controller 124 may be configured to communicate with an indoor fan controller 142 and/or otherwise affect control over operation of the indoor fan 110. In some embodiments, the indoor personality module 134 may comprise information related to the identification and/or operation of the indoor unit 102 and/or a position of the outdoor metering device 120.

In some embodiments, the indoor EEV controller 138 may be configured to receive information regarding temperatures and pressures of the refrigerant in the indoor unit 102. More specifically, the indoor EEV controller 138 may be configured to receive information regarding temperatures and pressures of refrigerant entering, exiting, and/or within the indoor heat exchanger 108. Further, the indoor EEV controller 138 may be configured to communicate with the indoor metering device 112 and/or otherwise affect control over the indoor metering device 112.

The outdoor controller 126 may be carried by the outdoor unit 104 and may be configured to receive information inputs, transmit information outputs, and otherwise communicate with the system controller 106, the indoor controller 124, and/or any other device via the communication bus 128 and/or any other suitable medium of communication. In some embodiments, the outdoor controller 126 may be configured to communicate with an outdoor personality module 140 that may comprise information related to the identification and/or operation of the outdoor unit 104. In some embodiments, the outdoor controller 126 may be configured to receive information related to an ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116. In some embodiments, the outdoor controller 126 may be configured to transmit information related to monitoring, communicating with, and/or otherwise affecting control over the outdoor fan 118, a compressor sump heater, a solenoid of the reversing valve 122, a relay associated with adjusting and/or monitoring a refrigerant charge of the HVAC system 100, a position of the indoor metering device 112, and/or a position of the outdoor metering device 120. The outdoor controller 126 may further be configured to communicate with a compressor drive controller 144 that is configured to electrically power and/or control the compressor 116.

The HVAC system 100 is shown configured for operating in a so-called cooling mode in which heat is absorbed by refrigerant at the indoor heat exchanger 108 and heat is rejected from the refrigerant at the outdoor heat exchanger 114. In some embodiments, the compressor 116 may be operated to compress refrigerant and pump the relatively high temperature and high pressure compressed refrigerant from the compressor 116 to the outdoor heat exchanger 114 through the reversing valve 122 and to the outdoor heat exchanger 114. As the refrigerant is passed through the outdoor heat exchanger 114, the outdoor fan 118 may be operated to move air into contact with the outdoor heat exchanger 114, thereby transferring heat from the refrigerant to the air surrounding the outdoor heat exchanger 114. The refrigerant may primarily comprise liquid phase refrigerant and the refrigerant may be pumped from the outdoor heat exchanger 114 to the indoor metering device 112 through and/or around the outdoor metering device 120 which does not substantially impede flow of the refrigerant in the cooling mode. The indoor metering device 112 may meter passage of the refrigerant through the indoor metering device 112 so that the refrigerant downstream of the indoor metering device 112 is at a lower pressure than the refrigerant upstream of the indoor metering device 112. The pressure differential across the indoor metering device 112 allows the refrigerant downstream of the indoor metering device 112 to expand and/or at least partially convert to gaseous phase. The gaseous phase refrigerant may enter the indoor heat exchanger 108. As the refrigerant is passed through the indoor heat exchanger 108, the indoor fan 110 may be operated to move air into contact with the indoor heat exchanger 108, thereby transferring heat to the refrigerant from the air surrounding the indoor heat exchanger 108. The refrigerant may thereafter reenter the compressor 116 after passing through the reversing valve 122.

To operate the HVAC system 100 in the so-called heating mode, the reversing valve 122 may be controlled to alter the flow path of the refrigerant, the indoor metering device 112 may be disabled and/or bypassed, and the outdoor metering device 120 may be enabled. In the heating mode, refrigerant may flow from the compressor 116 to the indoor heat exchanger 108 through the reversing valve 122, the refrigerant may be substantially unaffected by the indoor metering device 112, the refrigerant may experience a pressure differential across the outdoor metering device 120, the refrigerant may pass through the outdoor heat exchanger 114, and the refrigerant may reenter the compressor 116 after passing through the reversing valve 122. Most generally, operation of the HVAC system 100 in the heating mode reverses the roles of the indoor heat exchanger 108 and the outdoor heat exchanger 114 as compared to their operation in the cooling mode.

Figure 2:
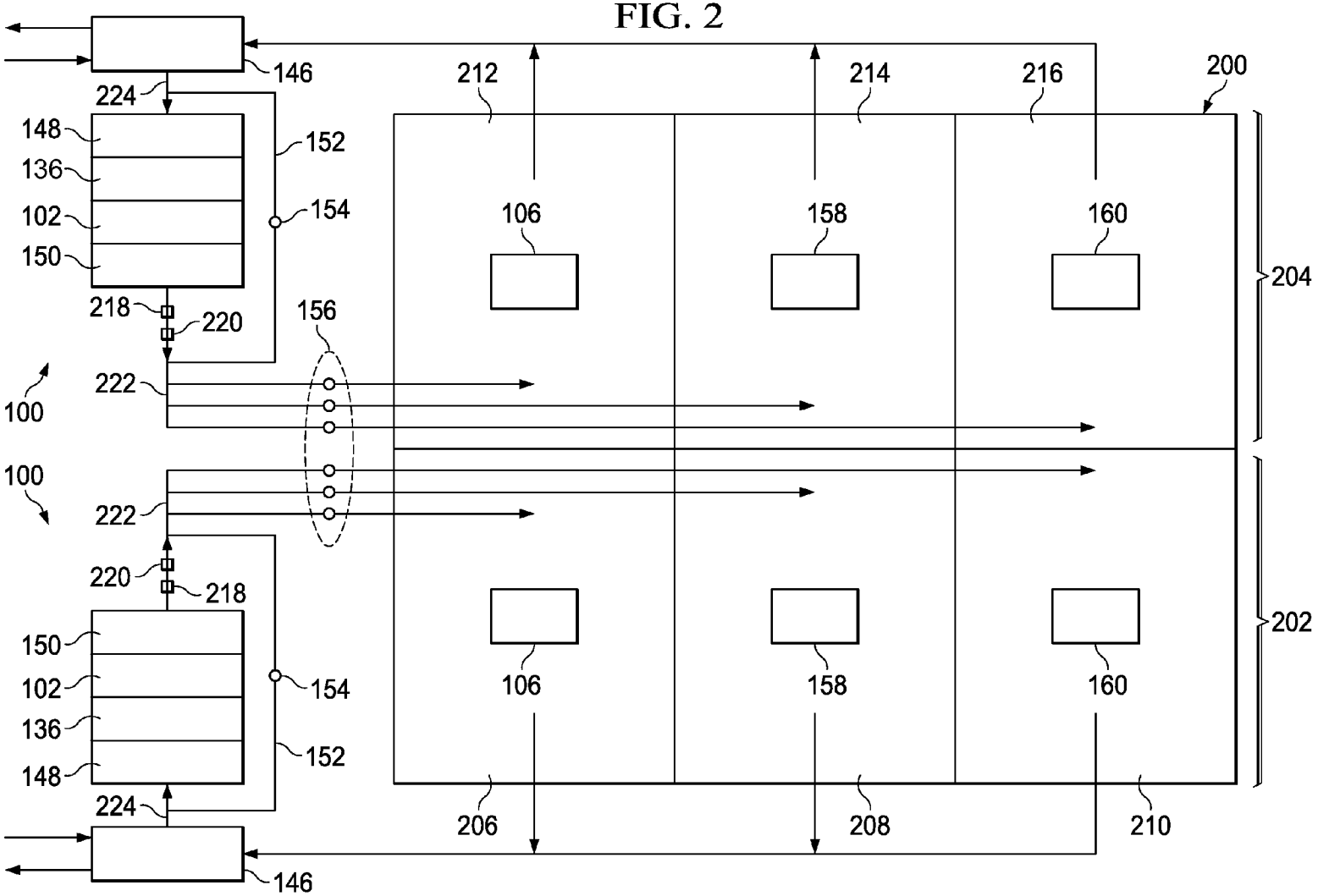
FIG. 2 is a schematic diagram of the air circulation paths of the HVAC system of FIG. 1.

Referring now to FIG. 2, a simplified schematic diagram of the air circulation paths for a structure 200 conditioned by two HVAC systems 100 is shown. In this embodiment, the structure 200 is conceptualized as comprising a lower floor 202 and an upper floor 204. The lower floor 202 comprises zones 206, 208, and 210 while the upper floor 204 comprises zones 212, 214, and 216. The HVAC system 100 associated with the lower floor 202 is configured to circulate and/or condition air of lower zones 206, 208, and 210 while the HVAC system 100 associated with the upper floor 204 is configured to circulate and/or condition air of upper zones 212, 214, and 216.

In addition to the components of HVAC system 100 described above, in this embodiment, each HVAC system 100 further comprises a ventilator 146, a prefilter 148, a humidifier 150, and a bypass duct 152. The ventilator 146 may be operated to selectively exhaust circulating air to the environment and/or introduce environmental air into the circulating air. The prefilter 148 may generally comprise a filter media selected to catch and/or retain relatively large particulate matter prior to air exiting the prefilter 148 and entering the air cleaner 136. The humidifier 150 may be operated to adjust a humidity of the circulating air. The bypass duct 152 may be utilized to regulate air pressures within the ducts that form the circulating air flow paths. In some embodiments, air flow through the bypass duct 152 may be regulated by a bypass damper 154 while air flow delivered to the zones 206, 208, 210, 212, 214, and 216 may be regulated by zone dampers 156.

Still further, each HVAC system 100 may further comprise a zone thermostat 158 and a zone sensor 160. In some embodiments, a zone thermostat 158 may communicate with the system controller 106 and may allow a user to control a temperature, humidity, and/or other environmental setting for the zone in which the zone thermostat 158 is located. Further, the zone thermostat 158 may communicate with the system controller 106 to provide temperature, humidity, and/or other environmental feedback regarding the zone in which the zone thermostat 158 is located. In some embodiments, a zone sensor 160 may communicate with the system controller 106 to provide temperature, humidity, and/or other environmental feedback regarding the zone in which the zone sensor 160 is located.

Each HVAC system 100 may further comprise a pressure sensor 218 and a temperature sensor 220. The pressure sensor 218 may provide a pressure measurement of the supply air within a supply header 222. The temperature sensor 220 may provide a temperature measurement of the supply air within the supply header 222. The pressure sensor 218 and the temperature sensor 220 may provide information to the system controller 106 and the indoor controller 124 for purposes of managing excess air conditions. Each HVAC system 100 may further comprise a return input 224 into which airflow exiting bypass duct 152 may be fed.

While HVAC systems 100 are shown as a so-called split system comprising an indoor unit 102 located separately from the outdoor unit 104, alternative embodiments of an HVAC system 100 may comprise a so-called package system in which one or more of the components of the indoor unit 102 and one or more of the components of the outdoor unit 104 are carried together in a common housing or package. The HVAC system 100 is shown as a so-called ducted system where the indoor unit 102 is located remote from the conditioned zones, thereby requiring air ducts to route the circulating air. However, in alternative embodiments, an HVAC system 100 may be configured as a non-ducted system in which the indoor unit 102 and/or multiple indoor units 102 associated with an outdoor unit 104 is located substantially in the space and/or zone to be conditioned by the respective indoor units 102, thereby not requiring air ducts to route the air conditioned by the indoor units 102.

Still referring to FIG. 2, the system controllers 106 may be configured for bidirectional communication with each other and may further be configured so that a user may, using any of the system controllers 106, monitor and/or control any of the HVAC system 100 components regardless of which zones the components may be associated. Further, each system controller 106, each zone thermostat 158, and each zone sensor 160 may comprise a humidity sensor. As such, it will be appreciated that structure 200 is equipped with a plurality of humidity sensors in a plurality of different locations. In some embodiments, a user may effectively select which of the plurality of humidity sensors is used to control operation of one or more of the HVAC systems 100.

Figure 3:
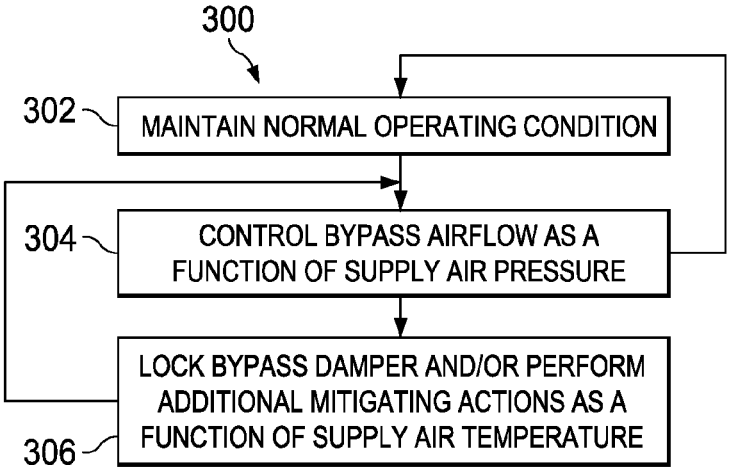
FIG. 3 is a flowchart of a method of managing an HVAC excess air condition according to an embodiment of the disclosure.

Referring now to FIG. 3, a flowchart of a method 300 of managing HVAC an excess air condition according to an embodiment of the disclosure is shown. In some embodiments, the excess air condition may be managed by first controlling the bypass dampers 154 to allow bypass airflow. In some embodiments, where controlling the bypass dampers 154 is insufficient to manage the excess air condition, additional mitigating actions may be necessary. The mitigating actions may comprise changes in the air delivery to the zones 206, 208, 210, 212, 214, and 216 by modulating one or more of the zone dampers 156.

Depending on (1) the operational condition of the temperature of a zone relative to a desired temperature for the zone and (2) relative to the mode (heating or cooling) in which the HVAC system 100 is operating, a zone may be referred to as one or more of calling, non-calling, same-mode, and opposing-mode. When a temperature of a zone has not yet met a desired temperature for the zone and the zone is set to selectively to receive conditioned air from the HVAC system 100 as it operates in the current mode (heating or cooling), the zone may be referred to as a same-mode calling zone. When a temperature of a zone has met or has gone beyond a desired temperature for the zone and the zone is set to selectively to receive conditioned air from the HVAC system 100 as it operates in the current mode (heating or cooling), the zone may be referred to as a same-mode non-calling zone. For example, a zone may be a same-mode zone when the zone selectively receives heated air from the HVAC system 100 while the HVAC system 100 is operating in a heating mode and when the zone selectively receives cooled air from the HVAC system 100 while the HVAC system 100 is operating in a cooling mode.

When a zone is set to only receive air from the HVAC system 100 when the HVAC system 100 is operating in a mode that is opposite or different than a mode in which the HVAC system 100 is operating in, the zone may be referred to as an opposing-mode zone. For example, a zone may be an opposing-mode zone when the zone is set to selectively receive heated air from the HVAC system 100 while the HVAC system 100 is operating in a cooling mode and when the zone is set to selectively receive cooled air from the HVAC system 100 while the HVAC system 100 is operating in a heating mode. When a zone is set to not receive air from the HVAC system 100 regardless of the mode in which the HVAC system 100 is operating, the zone may be referred to as an off-mode zone.

The method 300 may begin at block 302 where the HVAC system 100 may begin at a normal operating condition with no bypass or other mitigating actions occurring in response to any excess air condition.

At block 304, the indoor controller 124 may control bypass airflow as a function of supply air pressure measured from the pressure sensor 218. If the supply air pressure is below a threshold pressure value, then the method 300 may continue operating normally and the method may return to normal operating condition at block 302. Otherwise, if the supply air pressure is equal to or greater than the threshold pressure value, then the method 300 may proceed to block 306. The indoor controller 124 may control bypass airflow by modulating the bypass dampers 154.

At block 306, the indoor controller 124 may instruct additional mitigating actions as a function of supply air temperature measured from the temperature sensor 220. If the supply air temperature is above a threshold supply air temperature value while the HVAC system is operating in a cooling mode or the supply air temperature is below a threshold supply air temperature value while the HVAC system 100 is operating in a heating mode, then the method 300 may continue the bypass based mitigation action and return to block 304. Otherwise, if the supply air temperature is equal to or less than a threshold supply air temperature value while the HVAC system is operating in a cooling mode or the supply air temperature is equal to or greater than a threshold supply air temperature value while the HVAC system 100 is operating in a heating mode, then the method 300 may cause a change in control of the bypass airflow and/or cause additional actions to mitigate excess air conditions. In some embodiments, the change in control of the bypass airflow may comprise locking the position of a bypass damper 154 and/or modulating a zone damper 156 to allow relatively more airflow to a zone associated with the zone damper 156.

Figure 4A:
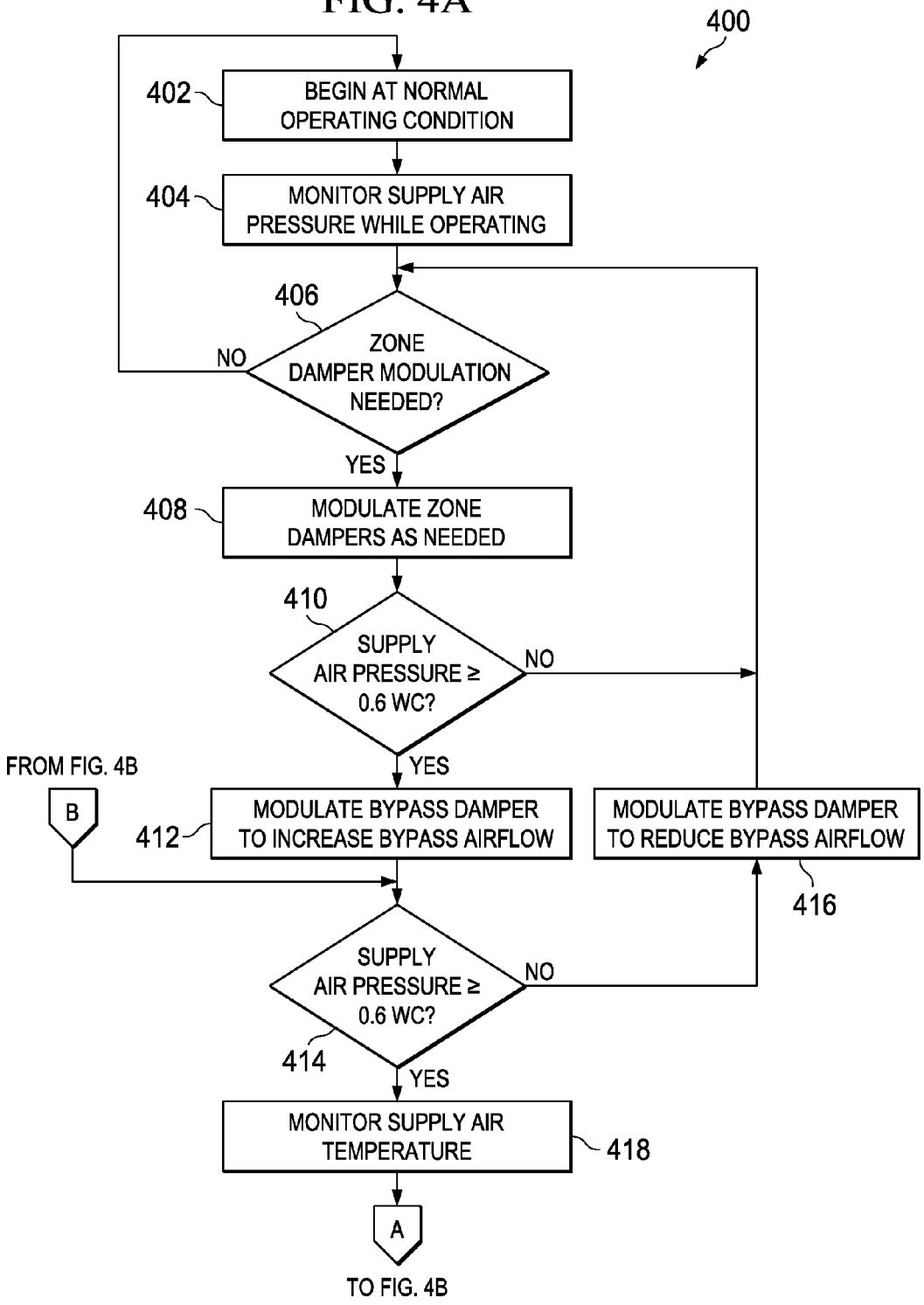
FIGS. 4A and 4B, together, provide a flowchart of another method of managing an HVAC excess air condition according to an embodiment of the disclosure.
Figure 4B:
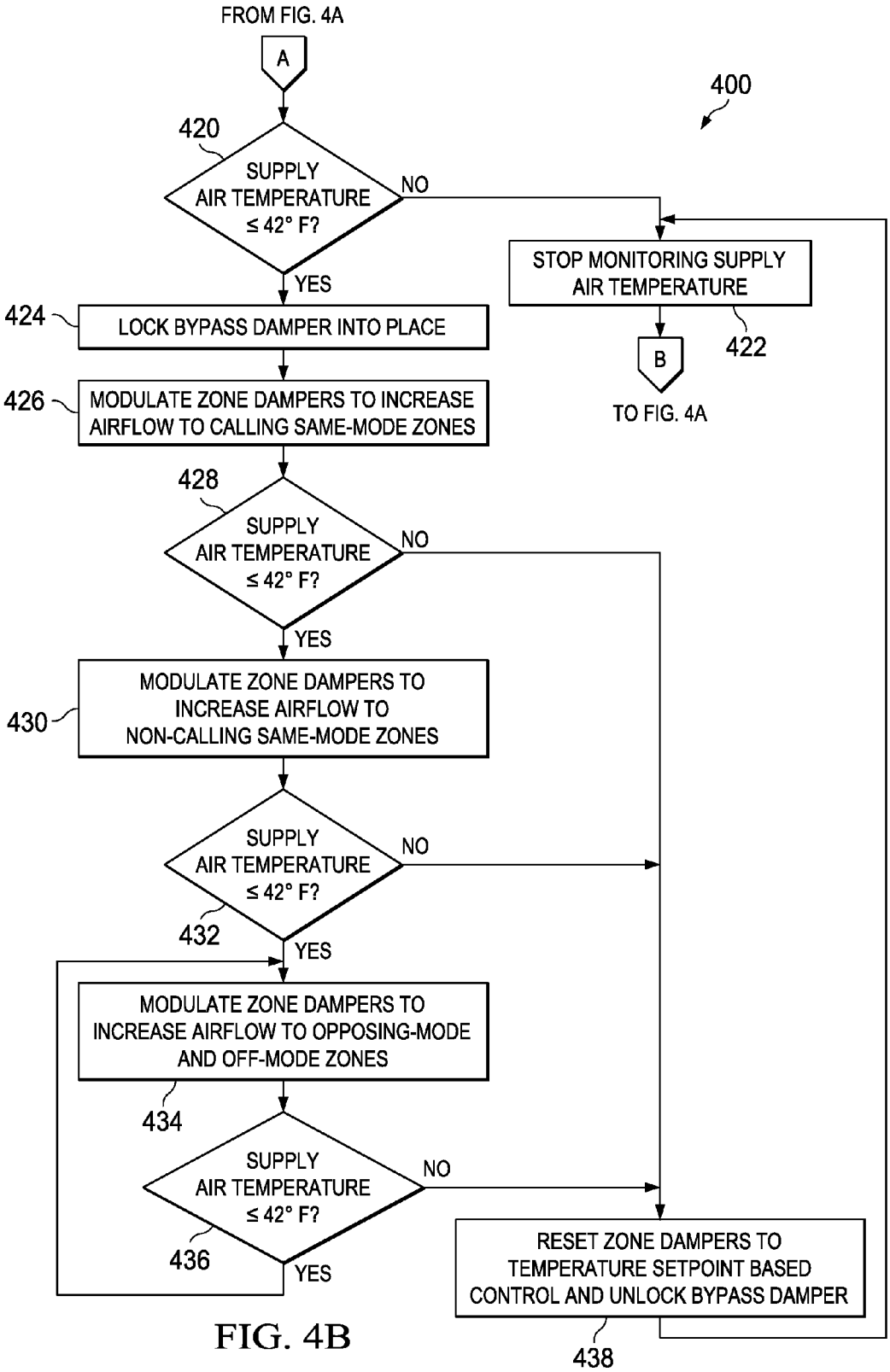

Referring now to FIGS. 4A and 4B, a flowchart of a method 400 of managing an excess air condition according to another embodiment of the disclosure is shown. The method 400 may begin at block 402 where the HVAC system 100 may begin at a normal operating condition with no bypass or other mitigating actions occurring in response to any excess air condition. For purposes of describing the method 400, the HVAC system may be operating in a cooling mode.

At block 404, the pressure sensor 218 may monitor the supply air pressure throughout the method 400.

At block 406, the method may determine whether zone damper 156 modulation is needed. In some cases, zone damper 156 modulation may be needed to control the temperatures in the respective zones 206, 208, 210, 212, 214, and 216 according to associated temperature setpoints for the zones 206, 208, 210, 212, 214, and 216. For example, if zone 208 has cooled the zone 208 to a temperature value equal to or below a temperature setpoint for zone 208, then the HVAC system 100 may need to modulate a zone damper 156 corresponding to zone 208 to reduce or stop the supply of cooled air to zone 208. If zone damper 156 modulation is not needed, then the method 400 may return to block 402. Otherwise, if zone damper 156 modulation is needed, then the method 400 may proceed to block 408.

At block 408, the indoor controller 124 may modulate the zone dampers 156 as needed to alter airflow to one or more of the zones 206, 208, 210, 212, 214, and 216. In some cases, partial and/or complete closure of one or more zone dampers 156 may create an excess air condition and/or an increase in the supply air pressure as measured by the pressure sensor 218. It will be appreciated that during installation of the HVAC system 100, a threshold supply air pressure may be provided. The threshold supply air pressure may be changed at a subsequent to installation. The threshold supply air pressure may be provided as a value between about 0.4 to about 1.0 WC (inches of water [4° C.]). For the purpose of explaining method 400, the threshold supply air pressure is considered to be set as 0.7 WC.

At block 410, if the supply air pressure as measured by the pressure sensor 218 is below 0.1 WC of the threshold supply air pressure, in other words, if the supply air pressure is below 0.6 WC, then the method 400 may return to block 406. Otherwise, if the supply air pressure is 0.6 WC or greater, then the method 400 may proceed to block 412.

At block 412, the indoor controller 124 may modulate the bypass damper 154 to allow an increased amount of bypass airflow through the bypass duct 152. By increasing the bypass airflow from the supply plenum 222 through the bypass damper 154 and bypass duct 152 and back to the return input 224, thereby potentially reducing the supply air pressure. The pressure sensor 218 may continue to monitor the supply air pressure.

At block 414, if the supply air pressure decreases to a value below 0.6 WC, then the method 400 may proceed to block 416 to modulate the bypass damper 154 to reduce an amount of bypass airflow and thereafter return to block 406. Otherwise, if the supply air pressure remains at or above 0.6 WC, then the method 400 may proceed to block 418. A time delay may be utilized before taking an action in response to determining the supply air pressure at block 414 in order to allow the bypass damper 154 to cause a reduction in supply air pressure.

During installation of the HVAC system 100, a supply air temperature safety trip points for each type of operating mode may be provided. The safety trip points may be changed subsequent to installation. Table 1 provides a set of possible supply air temperature safety trip points. For purposes of explaining method 400, the HVAC system 100 is described as operating in a cooling mode using the bypass duct 152 and bypass damper 154 and the corresponding safety trip point may be 38° F. for adjusted cooling, a cooling mode that may utilize bypass airflow. If the HVAC system 100 were not configured to selectively utilize the bypass duct 152 and bypass damper 154, then the corresponding safety trip point may be 42° F. for normal cooling.

TABLE 1

| Mode of Operation | Safety Trip Point (° F.) |
|---|---|
| Normal Cooling | 42 |
| Adjusted Cooling | 38 |
| Normal HP Heating | 116 |
| Adjusted HP Heating | 128 |
| Normal HP + Strip Heating | 160 |
| Adjusted HP + Strip Heating | 170 |
| Normal Gas Furnace | 135 |
| Adjusted Gas Furnace | 145 |

TABLE 1-continued

| Mode of Operation | Safety Trip Point (° F.) |
|---|---|
| Normal Oil Furnace | 160 |
| Adjusted Oil Furnace | 170 |

At block 418, the temperature sensor 220 may monitor supply air temperature until otherwise noted.

At block 420, if the supply air temperature is not within 4° of the supply air temperature safety trip point, in other words, if the supply air temperature is above 42° F., then the method 400 may proceed to block 422 to stop monitoring supply air temperature and subsequently return to block 414. Otherwise, if the supply air temperature is equal to or less than 42° F., then the method 400 may proceed to block 424.

At block 424, the bypass damper 154 may be locked into place at its current position, and the method 400 may proceed to cause additional mitigating actions in order to reduce the supply air temperature and/or mitigate an excess air condition. For purposes of explaining method 400, zone 206 is a calling same-mode zone, zone 208 is a non-calling same mode zone, zone 210 is an opposing-mode zone, and zone 212 is an off-mode zone.

At block 426, the HVAC system 100 may modulate the zone dampers 156 corresponding to all calling same-mode zones, such as zone 206, to 100% percent open. In other words, the HVAC system 100 may manage zone dampers 156 corresponding to calling same-mode zones to potentially reduce a mass flow rate of bypass airflow, potentially increase the supply air temperature, and potentially reduce a supply air pressure. The temperature sensor 220 may continue to monitor the supply air temperature.

At block 428, if the supply air temperature increases to a value above 42° F., then the method 400 may proceed to block 438 to unlock the bypass damper 154 and return control of all zone dampers 156 to temperature setpoint based control, proceed to block 422 to stop monitoring supply air temperature, and return to block 414. Otherwise, if the supply air temperature remains at or below 42° F., then the method 400 may proceed to block 430. There may be a time delay utilized prior to determining the supply air temperature at block 428 in order to allow the zone damper 156 for zone 206 to cause an increase in supply air temperature.

At block 430, the HVAC system 100 may modulate the zone dampers 156 corresponding to all non-calling same-mode zones, such as zone 208, to 25% percent open. In other words, the HVAC system 100 may manage zone dampers 156 corresponding to non-calling same-mode zones to potentially reduce a mass flow rate of bypass airflow, potentially increase the supply air temperature, and potentially reduce a supply air pressure. The temperature sensor 220 may continue to monitor the supply air temperature.

At block 432, if the supply air temperature increases to a value above 42° F., then the method 400 may proceed to block 438 to unlock the bypass damper 154 and return control of all zone dampers 156 to temperature setpoint based control, proceed to block 422 to stop monitoring supply air temperature, and return to block 414. Otherwise, if the supply air temperature remains equal to or less than 42° F., then the method 400 may proceed to block 434. There may be a time delay utilized prior to determining the supply air temperature at block 432 in order to allow the zone damper 156 for zone 208 to cause an increase in supply air temperature.

At block 434, the HVAC system 100 may modulate the zone dampers 156 corresponding to all opposing-mode zones and off-mode zones, such as zones 208 and 210, to 25% percent open. In other words, the HVAC system 100 may manage zone dampers 156 corresponding opposing-mode zones and off-mode zones to potentially reduce a mass flow rate of bypass airflow, potentially increase the supply air temperature, and potentially reduce a supply air pressure. The temperature sensor 220 may continue to monitor the supply air temperature.

At block 436, if the supply air temperature increases to a value above 42° F., then the method 400 may proceed to block 438 to unlock the bypass damper 154 and return control of all zone dampers 156 to temperature setpoint based control, proceed to block 422 to stop monitoring supply air temperature, and return to block 414. Otherwise, if the supply air temperature remains equal to or less than 42° F., then the method 400 may proceed to back to block 434. There may be a time delay utilized prior to determining the supply air temperature at block 436 in order to allow the zone dampers 156 for zones 208 and 210 to cause an increase in supply air temperature.

It should be noted that, even though the HVAC system 100 monitors supply air temperature throughout the method 400 for purposes of controlling bypass and mitigating actions, the HVAC system 100 also monitors supply air temperature to ensure for the purpose of implementing other temperature related controls, such as, but not limited to, temperature based HVAC system 100 shutdown controls.

Figure 5:
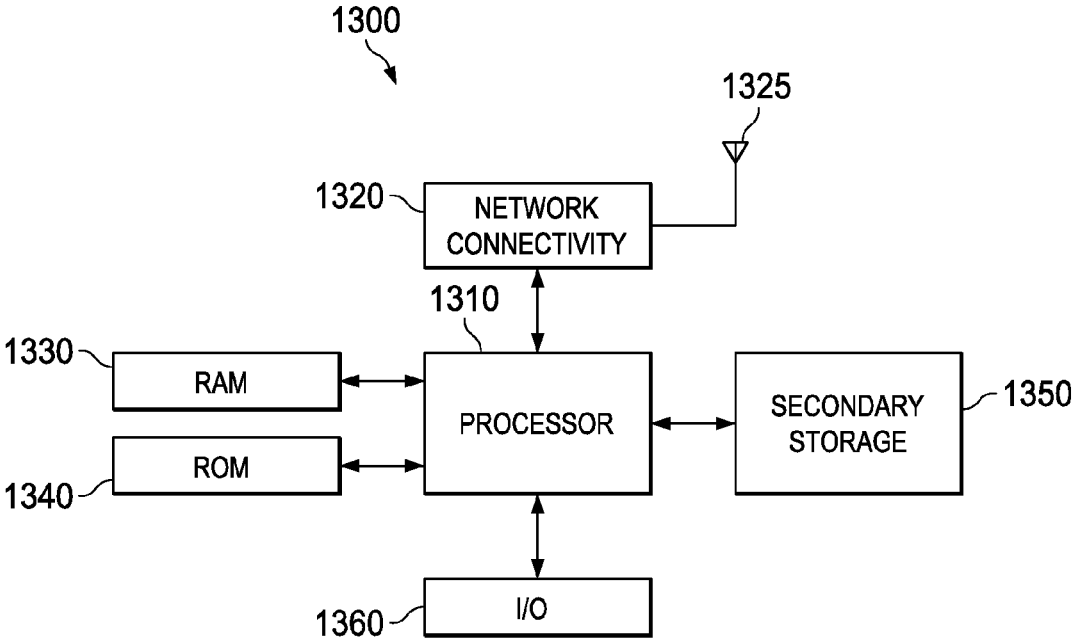
FIG. 5 is a simplified representation of a general-purpose processor (e.g., electronic controller or computer) system suitable for implementing the embodiments of the disclosure.

FIG. 5 illustrates a typical, general-purpose processor (e.g., electronic controller or computer) system 1300 that includes a processing component 1310 suitable for implementing one or more embodiments disclosed herein. In addition to the processor 1310 (which may be referred to as a central processor unit or CPU), the system 1300 might include network connectivity devices 1320, random access memory (RAM) 1330, read only memory (ROM) 1340, secondary storage 1350, and input/output (I/O) devices 1360. In some cases, some of these components may not be present or may be combined in various combinations with one another or with other components not shown. These components might be located in a single physical entity or in more than one physical entity. Any actions described herein as being taken by the processor 1310 might be taken by the processor 1310 alone or by the processor 1310 in conjunction with one or more components shown or not shown in the drawing.

The processor 1310 executes instructions, codes, computer programs, or scripts that it might access from the network connectivity devices 1320, RAM 1330, ROM 1340, or secondary storage 1350 (which might include various disk-based systems such as hard disk, floppy disk, optical disk, or other drive). While only one processor 1310 is shown, multiple processors may be present. Thus, while instructions may be discussed as being executed by a processor, the instructions may be executed simultaneously, serially, or otherwise by one or multiple processors. The processor 1310 may be implemented as one or more CPU chips.

The network connectivity devices 1320 may take the form of modems, modem banks, Ethernet devices, universal serial bus (USB) interface devices, serial interfaces, token ring devices, fiber distributed data interface (FDDI) devices, wireless local area network (WLAN) devices, radio transceiver devices such as code division multiple access (CDMA) devices, global system for mobile communications (GSM) radio transceiver devices, worldwide interoperability for microwave access (WiMAX) devices, and/or other well-known devices for connecting to networks. These network connectivity devices 1320 may enable the processor 1310 to communicate with the Internet or one or more telecommunications networks or other networks from which the processor 1310 might receive information or to which the processor 1310 might output information.

The network connectivity devices 1320 might also include one or more transceiver components 1325 capable of transmitting and/or receiving data wirelessly in the form of electromagnetic waves, such as radio frequency signals or microwave frequency signals. Alternatively, the data may propagate in or on the surface of electrical conductors, in coaxial cables, in waveguides, in optical media such as optical fiber, or in other media. The transceiver component 1325 might include separate receiving and transmitting units or a single transceiver. Information transmitted or received by the transceiver 1325 may include data that has been processed by the processor 1310 or instructions that are to be executed by processor 1310. Such information may be received from and outputted to a network in the form, for example, of a computer data baseband signal or signal embodied in a carrier wave. The data may be ordered according to different sequences as may be desirable for either processing or generating the data or transmitting or receiving the data. The baseband signal, the signal embedded in the carrier wave, or other types of signals currently used or hereafter developed may be referred to as the transmission medium and may be generated according to several methods well known to one skilled in the art.

The RAM 1330 might be used to store volatile data and perhaps to store instructions that are executed by the processor 1310. The ROM 1340 is a non-volatile memory device that typically has a smaller memory capacity than the memory capacity of the secondary storage 1350. ROM 1340 might be used to store instructions and perhaps data that are read during execution of the instructions. Access to both RAM 1330 and ROM 1340 is typically faster than to secondary storage 1350. The secondary storage 1350 is typically comprised of one or more disk drives or tape drives and might be used for non-volatile storage of data or as an over-flow data storage device if RAM 1330 is not large enough to hold all working data. Secondary storage 1350 may be used to store programs or instructions that are loaded into RAM 1330 when such programs are selected for execution or information is needed.

The I/O devices 1360 may include liquid crystal displays (LCDs), touch screen displays, keyboards, keypads, switches, dials, mice, track balls, voice recognizers, card readers, paper tape readers, printers, video monitors, transducers, sensors, or other well-known input or output devices. Also, the transceiver 1325 might be considered to be a component of the I/O devices 1360 instead of or in addition to being a component of the network connectivity devices 1320. Some or all of the I/O devices 1360 may be substantially similar to various components disclosed herein.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A heating, ventilation, and air conditioning (HVAC) system, comprising:

a controller;

a bypass duct configured to selectively receive a bypass airflow therethrough; and a bypass damper associated with the bypass duct, wherein the controller is configured to selectively modulate the bypass damper to increase the bypass airflow through the bypass duct in response to a supply air pressure of the HVAC system being greater than or equal to a supply air pressure threshold value;

wherein the controller is configured to discontinue modulation of the bypass damper to lock the bypass damper in its current position in response to a supply air temperature (1) being less than or equal to a supply air temperature threshold value when the HVAC system is operated in a cooling mode and (2) being greater than the supply air temperature threshold value when the HVAC system is operated in a heating mode;

wherein the controller is configured to modulate the at least one zone damper to the exclusion of the bypass damper that is locked in its current position to increase airflow to a zone of the HVAC system in response to the supply air temperature (1) being less than or equal to a supply air temperature threshold value of the HVAC system when the HVAC system is operated in the cooling mode and (2) being greater than or equal to a supply air temperature threshold value while the HVAC system is operating in the heating mode, and wherein the controller is configured to reset the at least one zone damper to a temperature setpoint based control position and unlock the bypass damper from its current position in response to the supply air temperature(1) exceeding the supply air temperature threshold value when the HVAC system is operated in a cooling mode and (2) being lower than the supply air temperature threshold value when the HVAC system is operated in a heating mode.

2. The system of claim 1, wherein the controller is configured to control the bypass airflow in response to the supply air temperature while the supply air pressure is greater than a supply air pressure threshold value.

3. The system of claim 2, wherein the controller is configured to lock a position of a bypass damper associated with the bypass duct in a current operating position in response to the supply air temperature being less than or equal to a supply air temperature threshold value when the HVAC system is operated in a cooling mode and in response to the supply air temperature being greater than or equal to the supply air temperature threshold value when the HVAC system is operated in a heating mode and in response to the supply air pressure remaining greater than or equal to the supply air pressure threshold value after the controller selectively modulates the bypass damper to increase the bypass airflow through the bypass duct.

4. The system of claim 1, wherein the controller is configured to modulate the zone damper to a fully open state from an open state.

5. The system of claim 1, wherein the controller is configured to modulate the zone damper to an open state from a closed state.

6. A method of managing an excess air condition of an HVAC system, comprising:

providing a controller configured to selectively control a position of a bypass damper and a position of at least one zone damper;

modulating airflow through a bypass duct by the controller modulating the position of the bypass damper to increase the airflow through the bypass duct in response to a supply air pressure exceeding a supply air pressure threshold value;

selectively discontinuing modulation of the bypass damper to lock the position of the bypass damper its current position by the controller in response to a supply air temperature (1) being less than or equal to a supply air temperature threshold value when the HVAC system is operated in a cooling mode and (2) being greater than the supply air temperature threshold value when the HVAC system is operated in a heating mode;

selectively adjusting by the controller the position of the at least one zone damper associated with a calling same-mode zone, non-calling same-mode zone, an opposing-mode zone, and an off-mode zone to increase airflow to at least one zone to the exclusion of the bypass damper that is locked in its current position in response to the supply air temperature (1) being less than or equal to the supply air temperature threshold value when the HVAC system is operated in a cooling mode and (2) being greater than or equal to the supply air temperature threshold value when the HVAC system is operated in a heating mode; and resetting by the controller the position of the at least one zone damper to a temperature setpoint based control position and unlocking by the controller the bypass damper from its current position in response to the supply air temperature (1) exceeding the supply air temperature threshold value when the HVAC system is operated in a cooling mode and (2) being lower than the supply air temperature threshold value when the HVAC system is operated in a heating mode.

7. The method of claim 6, wherein the at least one zone damper is associated with a calling same-mode zone.

8. The method of claim 6, wherein the at least one zone damper is associated with a non-calling same-mode zone.

9. The method of claim 6, wherein the at least one zone damper is associated with an opposing-mode zone.

10. The method of claim 6, wherein the at least one zone damper is associated with an off-mode zone.

11. The method of claim 6, further comprising:

selectively increasing airflow to a calling same-mode zone in response to the supply air temperature being less than or equal to the supply air temperature threshold value.

12. The method of claim 11, further comprising:

after selectively increasing airflow to the calling same-mode zone, selectively increasing airflow to a non-calling same mode zone in response to the supply air temperature remaining less than or equal to the supply air temperature threshold value.

13. The method of claim 12, further comprising:

after selectively increasing airflow to the non-calling same-mode zone, selectively increasing airflow to at least one of an opposing-mode zone and an off-mode zone in response to the supply air temperature remaining less than or equal to the supply air temperature threshold value.

14. A method of managing an excess air condition of an HVAC system, comprising:

providing a controller configured to selectively control a position of a bypass damper and a position of at least one zone damper associated with each of at least one calling same-mode zone, at least one non-calling same-mode zone, at least one opposing-mode zone, and at least one off-mode zone;

modulating airflow through a bypass duct by the controller modulating the position of the bypass damper to increase the airflow through the bypass duct in response to a supply air pressure exceeding a supply air pressure threshold value;

selectively discontinuing modulation of the bypass damper to lock the position of the bypass damper in its current position by the controller in response to (1) a supply air temperature being less than or equal to a supply air temperature threshold value when the HVAC system is operated in a cooling mode and (2) the supply air temperature being greater than the supply air temperature threshold value when the HVAC system is operated in a heating mode;

selectively increasing airflow to all calling same-mode zones to the exclusion of the bypass damper that is locked in its current position by the controller adjusting the position of the at least one zone damper associated with the at least one calling same-mode zone in response to the supply air temperature (1) being less than or equal to the supply air temperature threshold value when the HVAC system is operated in a cooling mode and (2) being greater than or equal to the supply air temperature threshold value when the HVAC system is operated in a heating mode;

after selectively increasing airflow to all calling same-mode zones, selectively increasing airflow to all non-calling same-mode zones to the exclusion of the bypass damper that is locked in its current position by the controller adjusting the position of the at least one zone damper associated with the at least one non-calling same-mode zone in response to the supply air temperature (1) continuing to be less than or equal to the supply air temperature threshold value when the HVAC system is operated in a cooling mode and (2) continuing to be greater than or equal to the supply air temperature threshold value when the HVAC system is operated in a heating mode;

after selectively increasing airflow to all non-calling same-mode zones, selectively increasing airflow to at least one of (1) an opposing-mode zone to the exclusion of the bypass damper that is locked in its current position by the controller adjusting the position of the at least one zone damper associated with the at least one opposing-mode zone and (2) an off-mode zone to the exclusion of the bypass damper that is locked in its current position by the controller adjusting the position of the at least one zone damper associated with the at least one off-mode zone in response to the supply air temperature continuing to be less than or equal to the supply air temperature threshold value when the HVAC system is operated in a cooling mode and in response to the supply air temperature being greater than or equal to the supply air temperature threshold value when the HVAC system is operated in a heating mode; and selectively reducing airflow to each calling same-mode zone, non-calling same mode zone, opposing-mode zone, and off-mode zone by the controller resetting the position of the at least one zone damper associated with each of the at least one calling same-mode zone, the at least one non-calling same mode zone, the at least one opposing-mode zone, and the at least one off-mode zone to a temperature setpoint based control and by the controller unlocking the bypass damper from its current position in response to the supply air temperature exceeding the supply air temperature threshold value when the HVAC system is operated in a cooling mode and in response to the supply air temperature being lower than the supply air temperature threshold value when the HVAC system is operated in a heating mode.

15. The method of claim 14, wherein the zone dampers associated with the calling same-mode zones are controlled by the controller to achieve greater percentage of potential openness relative to the percentage of potential openness to which the zone dampers associated with the non-calling same-mode zones are controlled to achieve.

* * * * *